US011361914B2

(12) United States Patent
Zhang et al.

(10) Patent No.: US 11,361,914 B2
(45) Date of Patent: Jun. 14, 2022

(54) ELECTRICAL CONTACTOR SYSTEM

(71) Applicant: Tyco Electronics (Shenzhen) Co. Ltd, Shenzhen (CN)

(72) Inventors: Xiaoning Zhang, Shenzhen (CN); Teng Zou, Shenzhen (CN)

(73) Assignee: Tyco Electronics (Shenzhen) Co. Ltd., Shenzhen (CN)

( * ) Notice: Subject to any disclaimer, the term of this patent is extended or adjusted under 35 U.S.C. 154(b) by 49 days.

(21) Appl. No.: 16/902,626

(22) Filed: Jun. 16, 2020

(65) Prior Publication Data

US 2020/0312584 A1 Oct. 1, 2020

Related U.S. Application Data

(63) Continuation of application No. PCT/EP2018/085949, filed on Dec. 19, 2018.

(30) Foreign Application Priority Data

Dec. 21, 2017 (CN) ..... 201711394216.0

(51) Int. Cl.
*H01H 9/44* (2006.01)
*H01H 50/38* (2006.01)

(52) U.S. Cl.
CPC ..... *H01H 9/443* (2013.01); *H01H 50/38* (2013.01)

(58) Field of Classification Search
CPC ..... H01H 1/2041; H01H 9/443; H01H 50/38; H01H 73/045; H01H 73/18; H01H 9/32;
(Continued)

(56) References Cited

U.S. PATENT DOCUMENTS 4,451,718 A * 5/1984 Yamagata ..... H01H 9/44 218/147
10,937,605 B2 * 3/2021 Zhang ..... H01H 73/18
(Continued)

FOREIGN PATENT DOCUMENTS

CN 202076163 U 12/2011
CN 102376505 A 3/2012
(Continued)

OTHER PUBLICATIONS

Machine translation of CN102376505A (Year: 2012).*
(Continued)

*Primary Examiner* — Bernard Rojas
(74) *Attorney, Agent, or Firm* — Barley Snyder

(57) ABSTRACT

An electrical contactor system includes a stationary contactor having a stationary contact, a moving contactor having a moving contact, a rotating member, a magnetic blow-out arc quenching device including a permanent magnet, and an isolation arc quenching device. The moving contactor is mounted on the rotating member and is rotatable between a connected position and a disconnected position. The moving contact is in electrical contact with the stationary contact when the moving contactor is rotated to the connected position, the moving contact is separated from the stationary contact when the moving contactor is rotated to the disconnected position. The permanent magnet is statically disposed in a vicinity of the stationary contactor for elongating an arc between the stationary contact and the moving contact by an electromagnetic force so as to extinguish the arc. The isolation arc quenching device pushes the arc toward the permanent magnet so as to force the arc to move to a vicinity of the permanent magnet.

21 Claims, 2 Drawing Sheets

(58) Field of Classification Search
CPC ..... H01H 1/20; H01H 73/04; H01H 9/34; H01H 9/44
See application file for complete search history.

(56) References Cited

U.S. PATENT DOCUMENTS

| | | | | |
|---|---|---|---|---|
| 2014/0048513 | A1* | 2/2014 | Sato | H01H 33/06 218/117 |
| 2014/0091062 | A1* | 4/2014 | Uitto | H01H 33/12 218/154 |
| 2015/0027983 | A1* | 1/2015 | Mattlar | H01H 9/36 218/23 |
| 2019/0348236 | A1* | 11/2019 | Oh | H01H 73/045 |

FOREIGN PATENT DOCUMENTS

| | | | |
|---|---|---|---|
| EP | 0061020 | A1 | 2/1982 |
| EP | 2650894 | A1 | 10/2013 |
| JP | 2005235670 | A | 9/2005 |

OTHER PUBLICATIONS

PCT Notification, The International Search Report and the Written Opinion of the International Searching Authority, International App. No. PCT/EP2018/085949, dated Mar. 29, 2019, 15 pages.
Abstract of JP2005235670, dated Sep. 2, 2005, 1 page.

* cited by examiner

ELECTRICAL CONTACTOR SYSTEM

CROSS-REFERENCE TO RELATED APPLICATIONS

This application is a continuation of PCT International Application No. PCT/EP2018/085949, filed on Dec. 19, 2018, which claims priority under 35 U.S.C. § 119 to Chinese Patent Application No. 201711394216.0, filed on Dec. 21, 2017.

FIELD OF THE INVENTION

The present invention relates to an electrical contactor system and, more particularly, to an electrical contactor system having an arc quenching device.

BACKGROUND

An electrical contact in a switch or controller electrical equipment will have a phenomenon of discharging and thus generate an arc while the electrical contacts are turned from on to off. The generated arc will delay the breaking of the circuit, and even burn the electrical contacts, thereby causing the electrical contacts to fuse. In more severe cases, the switch will burn and explode. Therefore, an arc quenching device is required to achieve efficient and reliable arc quenching.

A common switch device, such as a high-voltage direct current relay, usually uses sealed inflated air and an additional magnetic field to laterally elongate a metal phase arc. The arc is thus rapidly cooled, recombined, and deionized in an arc quenching medium, which is good for arc quenching, but quite complicated to manufacture, resulting in higher costs. There is another method for quenching arcs, in which a strong magnetic field in the air medium is used. Since the arc may be strongly ionized in the air medium, this kind of method is not ideal in quenching the arc, easily causes electrical contacts to fuse, and requires sufficient internal space, thereby limiting miniaturization of the switching device.

SUMMARY

An electrical contactor system includes a stationary contactor having a stationary contact, a moving contactor having a moving contact, a rotating member, a magnetic blow-out arc quenching device including a permanent magnet, and an isolation arc quenching device. The moving contactor is mounted on the rotating member and is rotatable between a connected position and a disconnected position. The moving contact is in electrical contact with the stationary contact when the moving contactor is rotated to the connected position, the moving contact is separated from the stationary contact when the moving contactor is rotated to the disconnected position. The permanent magnet is statically disposed in a vicinity of the stationary contactor for elongating an arc between the stationary contact and the moving contact by an electromagnetic force so as to extinguish the arc. The isolation arc quenching device pushes the arc toward the permanent magnet so as to force the arc to move to a vicinity of the permanent magnet.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
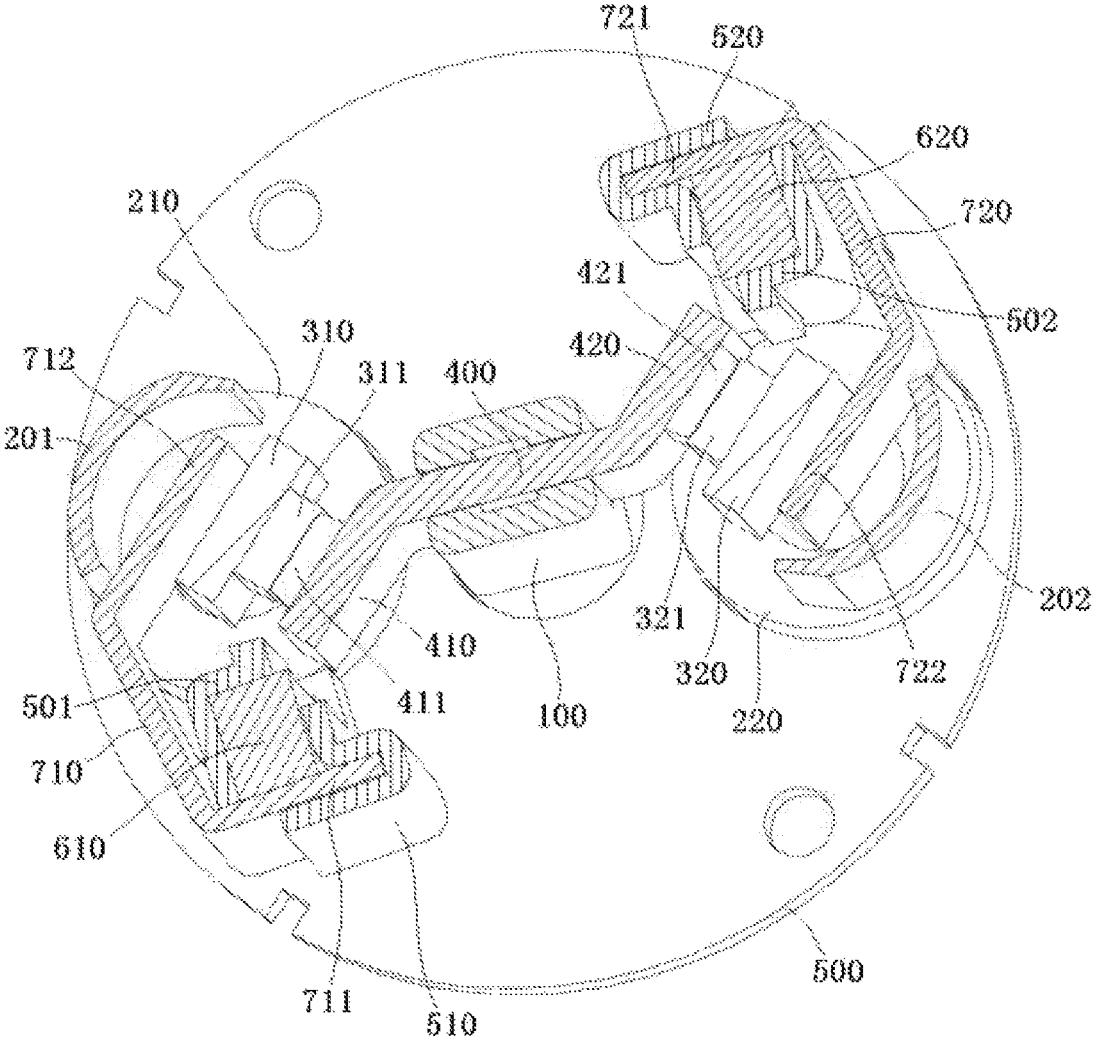
FIG. 1 is a sectional perspective view of an electrical contactor system according to an embodiment in which a moving contactor is in a state of contacting with a pair of stationary contactors.

Hereinafter, the technical solution of the present disclosure will be described in detail through the embodiments and the accompanying drawings. In the description, the same or similar reference numerals indicate the same or similar parts. The following description of the present disclosure is made to explain the general inventive concept of the present disclosure, and should not be construed as a limitation of the present disclosure.

Additionally, in the following detailed description, many specific details are set forth to provide a full understanding of the embodiments of the present disclosure. However, one or more embodiments may be practiced without these specific details. In other instances, well-known structures and devices are schematically shown in the drawings in order to simplify the drawings.

Figure 2:
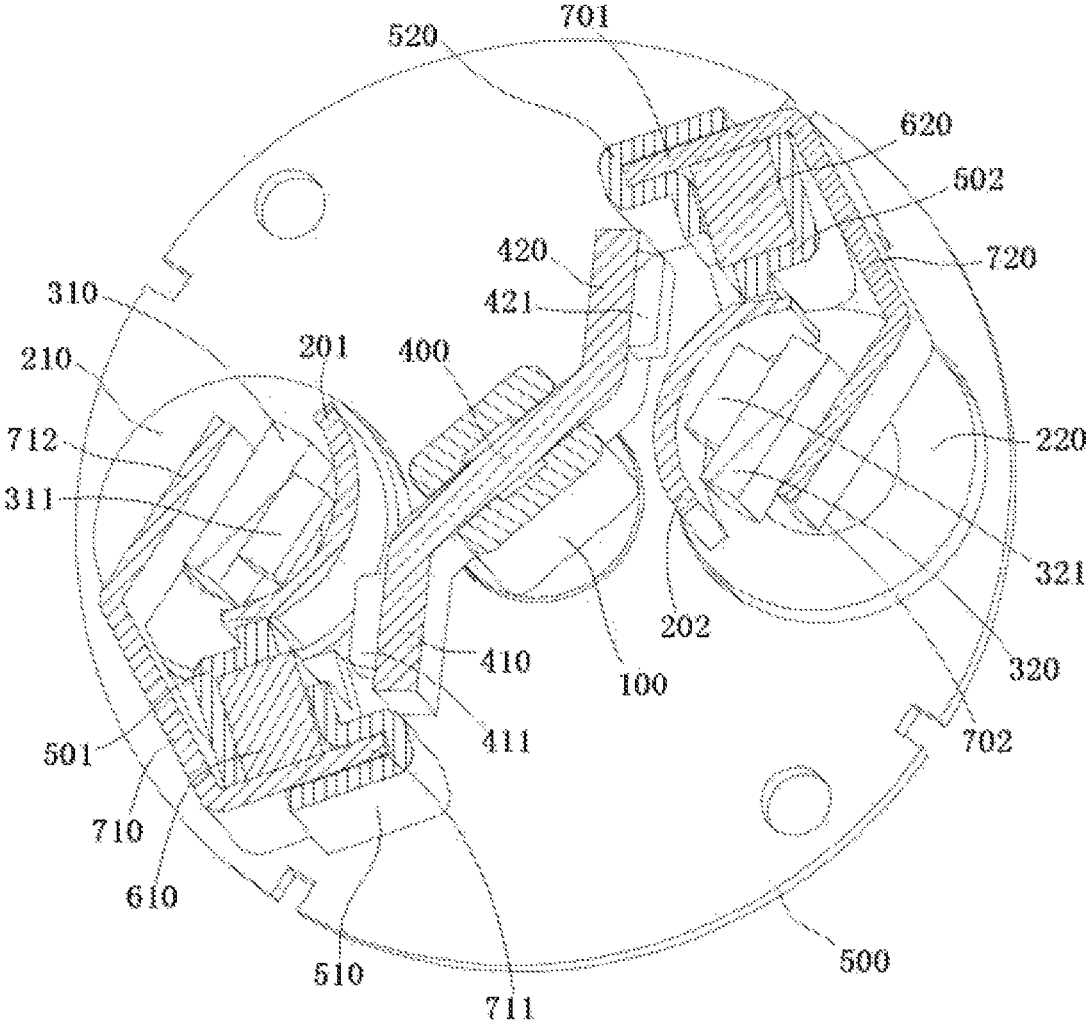
FIG. 2 is a sectional perspective view of the electrical contactor system in which the moving contactor is in a state of being separated from the pair of stationary contactors.

An electrical contactor system according to an embodiment, as shown in FIGS. 1 and 2, comprises a rotating member 100, a pair of stationary contactors 310, 320, and a moving contactor 400. The stationary contactors 310, 320 have stationary contacts 311, 321, respectively. The moving contactor 400 has a first moving contact 411 and a second moving contact 421. The moving contactor 400 is mounted on the rotating member 100, and may be rotated between a connected position (the position shown in FIG. 1) and a disconnected position (the position shown in FIG. 2) along with the rotating member 100.

Although FIG. 1 shows a pair of stationary contactors 310 and 320, it should be understood by the person skilled in the art that the present disclosure may also be used in the case where there is one single stationary contactor 310 or 320, and one moving contactor 400 having only one moving contact 411 or 421 at one end thereof, as long as the moving contactor 400 may be moved to the connected position in which it comes into contact with the stationary contactor, and also may be moved to the disconnected position in which it is disconnected with the stationary contactor. The number of the contacts provided on the moving contactor 400 and the number of the respective stationary contactors 310 and 320 are not limited to that shown in FIGS. 1 and 2.

As shown in FIG. 1, when the moving contactor 400 is rotated to the connected position, the moving contacts 411 and 421 are in electrical contact with the stationary contacts 311 and 321, respectively. As shown in FIG. 2, when the moving contactor 400 is rotated to the disconnected position, the moving contacts 411 and 421 are separated from the stationary contacts 311 and 321, respectively.

As shown in FIGS. 1 and 2, in the shown embodiment, the electrical contactor system comprises a plurality of magnetic blow-out arc quenching devices 610, 710, 620, 720, and a pair of isolation arc quenching devices 210 and 220. The magnetic blow-out arc quenching devices 610, 710, 620, 720 include permanent magnets 610 and 620, respectively, as shown in FIGS. 1 and 2. The permanent magnets 610 and 620 are statically disposed in the vicinity of the stationary contactors 310 and 320, respectively, and are configured to elongate arcs between the stationary contacts 311, 321 and the moving contacts 411, 421 by electromagnetic force so as to extinguish the arcs, respectively. The isolation arc quenching devices 210 and 220 are adapted to push the arcs toward the permanent magnets 610 and 620 so as to force the arcs to move to the vicinity of the permanent magnets 610 and 620, respectively, thereby improving an effect of magnetic blow-out arc quenching.

As shown in FIGS. 1 and 2, in the shown embodiment, the magnetic blow-out arc quenching devices 610, 710, 620, 720 include magnetic yokes 710 and 720, respectively. The permanent magnets 610, 620 and the stationary contactors 310, 320 are disposed in accommodation spaces surrounded by magnetic yokes 710 and 720, respectively, thereby reducing magnetic leakage so as to increase the intensity of electromagnetic induction in the accommodation spaces to increase electromagnetic force for elongating the arcs, which can speed up the arc quenching.

As shown in FIGS. 1 and 2, in the illustrated embodiment, the isolation arc quenching devices 210 and 220 have arc quenching sheets 201 and 202, and are meshed with the rotating member 100 by gears, and are rotatable under the drive of the rotating member 100, respectively. As shown in FIG. 1, in the illustrated embodiment, when the moving contactor 400 is rotated to the connected position, the arc quenching sheets 201 and 202 are rotated out of the contact regions of the moving contacts 411, 421 and the stationary contacts 311, 321 such that the moving contacts 411 and 421 come into electrical contact with the stationary contacts 311 and 321, respectively. As shown in FIG. 2, in the illustrated embodiment, when the moving contactor 400 is rotated to the disconnected position, the arc quenching sheets 201 and 202 are rotated into the contact regions of the moving contacts 411, 421 and the stationary contacts 311, 321 such that the moving contact 411, 421 and the stationary contact 311, 321 are electrically isolated so as to cut off the arcs, respectively.

As shown in FIGS. 1 and 2, in the illustrated embodiment, while the rotation of the moving contactor 400 is rotated from the connected position toward the disconnected position, the arc quenching sheets 201 and 202 push the arcs toward the permanent magnets 610 and 620 so as to force the arcs to move to the vicinity of the permanent magnets 610 and 620, respectively, thereby improving an effect of magnetic blow-out arc quenching.

As shown in FIGS. 1 and 2, in the illustrated embodiment, the electrical contactor system further comprises stationary insulating isolation walls 501 and 502. When the moving contactor 400 is rotated to a disconnected position, the arc quenching sheets 201, 202 and the insulating isolation walls 501, 502 form gaps therebetween or contact with each other, respectively, so as to speed up the cut-off of arcs.

As shown in FIGS. 1 and 2, in the illustrated embodiment, the electrical contactor system further comprises an insulating base 500, on which the insulating isolation walls 501 and 502 are formed, and on which the rotating member 100 and the isolation arc quenching devices 210 and 220 are rotatably mounted, respectively. Insulating fixing walls 510 and 520 are formed on the insulating base 500. The magnetic yoke 710 or 720 and the permanent magnet 610 or 620 are clamped and fixed between the fixing wall 510 or 520 and the insulating isolation wall 501 or 502.

As shown in FIGS. 1 and 2, in the illustrated embodiment, a first end 711 or 721 of the magnetic yoke 710 or 720 is inserted into a slot of the insulating fixing wall 510 or 520, and a second end 712 or 722 is on a side of the stationary contactor 310 or 320 that is opposite to the stationary contact 311 or 321. The permanent magnets 610 and 620 are embedded in mounting chambers defined by magnetic yokes 710 and 720, insulating fixing walls 510 and 520, and insulating isolation walls 501 and 502, respectively.

As shown in FIGS. 1 and 2, in the illustrated embodiment, the stationary contactors 310 and 320 comprise a first stationary contactor 310 and a second stationary contactor 320, and the moving contactor 400 is located between the first stationary contactor 310 and the second stationary contactor 320. The first stationary contactor 310 has a first stationary contact 311. The second stationary contactor 320 has a second stationary contact 321. A first end 410 of the moving contactor 400 has a first moving contact 411 for electrically contacting with the first stationary contact 311. A second end 420 of the moving contactor 400 has a second moving contact 421 for electrically contacting with the second stationary contact 321.

As shown in FIGS. 1 and 2, in the illustrated embodiment, the magnetic blow-out arc quenching devices 610, 710, 620, 720 comprise a first magnetic blow-out arc quenching device 610, 710 and a second magnetic blow-out arc quenching device 620, 720. The first magnetic blow-out arc quenching device 610, 710 comprises a first permanent magnet 610 statically disposed in the vicinity of the first stationary contactor 310 to extinguish a first arc between the first stationary contact 311 and the first moving contact 411. The second magnetic blow-out arc quenching device 620, 720 comprises a second permanent magnet 620 statically disposed in the vicinity of the second stationary contactor 320 to extinguish a second arc between the second stationary contact 321 and the second moving contact 421.

As shown in FIGS. 1 and 2, in the illustrated embodiment, the first magnetic blow-out arc quenching device 610, 710 further comprises a first magnetic yoke 710. The first permanent magnet 610 and the first stationary contactor 310 are disposed in a first accommodation space surrounded by the first magnetic yoke 710; thereby it may reduce magnetic leakage, so as to increase the intensity of electromagnetic induction in the first accommodation space. The second magnetic blow-out arc quenching device 620, 720 further comprises a second magnetic yoke 720. The second permanent magnet 620 and the second stationary contactor 320 are disposed in a second accommodation space surrounded by the second magnetic yoke 720; thereby it may reduce magnetic leakage, so as to increase the intensity of electromagnetic induction in the second accommodation space.

As shown in FIGS. 1 and 2, in the illustrated embodiment, the isolation arc quenching devices 210, 220 comprise a first isolation arc quenching device 210 and a second isolation arc quenching device 220. The first isolation arc quenching device 210 has a first arc quenching sheet 201. The second isolation arc quenching device 220 has a second arc quenching sheet 202.

As shown in FIG. 2, in the illustrated embodiment, when the moving contactor 400 is rotated to the disconnected position, the first arc quenching sheet 201 is rotated into the contact region of the first moving contact 411 and the first stationary contact 311 such that the first moving contact 411 is electrically isolated from the first stationary contact 311, so as to cut off the first arc. When the moving contactor 400 is rotated to the disconnected position, the second arc quenching sheet 202 is rotated into the contact region of the second moving contact 421 and the second stationary contact 321 such that the second moving contact 421 is electrically isolated from the second stationary contact 321, so as to cut off the second arc.

As shown in FIGS. 1 and 2, in the illustrated embodiment, while the moving contactor 400 is rotated from the connected position toward the disconnected position, the first arc quenching sheet 201 pushes the first arc toward the first permanent magnet 610 so as to force the first arc to move to the vicinity of the first permanent magnet 610. While the moving contactor 400 is rotated from the connected position toward the disconnected position, the second arc quenching sheet 202 pushes the second arc toward the second permanent magnet 620 so as to force the second arc to move to the vicinity of the second permanent magnet 620.

As shown in FIG. 1, in the illustrated embodiment, when the moving contactor 400 is rotated to the connected position, the first arc quenching sheet 201 is rotated out of the contact region of the first moving contact 411 and the first stationary contact 311 such that the first moving contact 411 is in electrical contact with the first stationary contact 311. When the moving contactor 400 is rotated to the connected position, the second arc quenching sheet 202 is rotated out of the contact region of the second moving contact 421 and the second stationary contact 321 such that the second moving contact 421 is in electrical contact with the second stationary contact 321.

As shown in FIGS. 1 and 2, in the illustrated embodiment, the insulating isolation walls 501 and 502 include a first insulating isolation wall 501 and a second insulating isolation wall 502. As shown in FIG. 2, in the illustrated embodiment, when the moving contactor 400 is rotated to the disconnected position, the first arc quenching sheet 201 and the first insulating isolation wall 501 form a gap therebetween or contact with each other so as to speed up the cut-off of the first arc. When the moving contactor 400 is rotated to the disconnected position, the second arc quenching sheet 202 and the second insulating isolation wall 502 form a gap therebetween or contact with each other so as to speed up the cutting off of the second arc.

As shown in FIGS. 1 and 2, in the illustrated embodiment, the insulating fixing walls 510 and 520 include a first insulating fixing wall 510 and a second insulating fixing wall 520. The first magnetic yoke 710 and the first permanent magnet 610 are clamped and fixed between the first insulating fixing wall 510 and the first insulating isolation wall 501. The second magnetic yoke 720 and the second permanent magnet 620 are clamped and fixed between the second insulating fixing wall 520 and the second insulating isolation wall 502.

As shown in FIGS. 1 and 2, in the illustrated embodiment, the first end 711 of the first magnetic yoke 710 is inserted into a slot of the first insulating fixing wall 510, and the second end 712 is on a side of the first stationary contactor 310 that is opposite to the first stationary contact 311. The first end 721 of the second magnetic yoke 720 is inserted into a slot of the second insulating fixing wall 520, and the second end 722 is on a side of the second stationary contactor 320 that is opposite to the second stationary contact 321. The first permanent magnet 610 is embedded in a mounting chamber defined by the first magnetic yoke 710, the first insulating fixing wall 510 and the first insulating isolation wall 501. The second permanent magnet 620 is embedded in a mounting chamber defined by the second magnetic yoke 720, the second insulating fixing wall 520 and the second insulating isolation wall 502.

The arc quenching sheet 201, 202 may enable rapid elongation of an arc, thereby forcing the arc to move to the vicinity of the permanent magnet 610, 620, increasing a magnetic blow-out path, while isolating the arc-generating path by the arc quenching sheet 201, 202 and the insulating isolation wall 501, 502, effectively improving the effect of arc quenching, and greatly accelerating the speed of arc quenching.

It will be understood by those skilled in the art that the above described embodiments are exemplary and can be modified by those skilled in the art, and the structures described in the various embodiments may be combined freely without subjecting to structural or principle conflicts. The present disclosure is described with reference to the accompanying drawings, but those embodiments disclosed in the drawings are intended to illustrate embodiments of the present disclosure, and are not to be construed as a limitation of the present disclosure.

While some of the embodiments of the present general inventive concept have been shown and described, it will be understood by those ordinarily skilled in the art that modifications may be made to these embodiments, and the scope of the present disclosure is limited by the claims and their equivalents, without departing from the principles and spirit of the present general inventive concept. It should be noted that the wording "comprising" does not exclude other elements or steps. The wording "a" or "an" does not exclude a plurality. Additionally, any component numerals in the claims should not be construed as limiting the scope of the present disclosure.

What is claimed is:

1. An electrical contactor system, comprising:

a stationary contactor having a stationary contact;

a moving contactor having a moving contact;

a rotating member, the moving contactor is mounted on the rotating member and is rotatable between a connected position and a disconnected position along with the rotating member, the moving contact is in electrical contact with the stationary contact when the moving contactor is rotated to the connected position, the moving contact is separated from the stationary contact when the moving contactor is rotated to the disconnected position;

a magnetic blow-out arc quenching device including a permanent magnet, the permanent magnet is statically disposed in a vicinity of the stationary contactor for elongating an arc between the stationary contact and the moving contact by an electromagnetic force so as to extinguish the arc;

an isolation arc quenching device rotated by the rotating member and adapted to push the arc toward the permanent magnet so as to force the arc to move to a vicinity of the permanent magnet, the isolation arc quenching device including an arc quenching sheet; and a stationary insulating isolation wall, the arc quenching sheet and the insulating isolation wall form a gap therebetween or contact with each other when the moving contactor is rotated to the disconnected position.

2. The electrical contactor system of claim 1, wherein the magnetic blow-out arc quenching device includes a magnetic yoke, the permanent magnet and the stationary contactor are disposed in an accommodation space surrounded by the magnetic yoke.

3. The electrical contactor system of claim 1, wherein the arc quenching sheet is rotated out of a contact region of the moving contact and the stationary contact and the moving contact is in electrical contact with the stationary contact when the moving contactor is rotated to the connected position.

4. The electrical contactor system of claim 3, wherein the arc quenching sheet is rotated into the contact region of the moving contact and the stationary contact and the moving contact is electrically isolated from the stationary contact so as to cut off the arc when the moving contactor is rotated to the disconnected position.

5. The electrical contact system of claim 4, wherein, while the moving contactor is rotated from the connected position toward the disconnected position, the arc quenching sheet pushes the arc toward the permanent magnet to force the arc to move to the vicinity of the permanent magnet.

6. The electrical contactor system of claim 1, further comprising an insulating base on which the insulating isolation wall is formed, the rotating member and the isolation arc quenching device are rotatably mounted on the insulating base.

7. The electrical contactor system of claim 6, wherein the magnetic blow-out arc quenching device includes a magnetic yoke, the permanent magnet and the stationary contactor are disposed in an accommodation space surrounded by the magnetic yoke, the insulating base has an insulating fixing wall, the magnetic yoke and the permanent magnet are clamped and fixed between the insulating fixing wall and the insulating isolation wall.

8. The electrical contactor system of claim 7, wherein a first end of the magnetic yoke is inserted into a slot of the insulating fixing wall and a second end of the magnetic yoke is on a side of the stationary contactor that is opposite to the stationary contact.

9. The electrical contactor system of claim 8, wherein the permanent magnet is embedded in a mounting chamber defined by the magnetic yoke, the insulating fixing wall, and the insulating isolation wall.

10. An electrical contactor system, comprising:

a stationary contactor having a stationary contact;

a moving contactor having a moving contact;

a rotating member, the moving contactor is mounted on the rotating member and is rotatable between a connected position and a disconnected position along with the rotating member, the moving contact is in electrical contact with the stationary contact when the moving contactor is rotated to the connected position, the moving contact is separated from the stationary contact when the moving contactor is rotated to the disconnected position;

a magnetic blow-out arc quenching device including a permanent magnet, the permanent magnet is statically disposed in a vicinity of the stationary contactor for elongating an arc between the stationary contact and the moving contact by an electromagnetic force so as to extinguish the arc; and an isolation arc quenching device rotated by the rotating member in a direction opposite to a rotational direction of the rotating member and adapted to push the arc toward the permanent magnet so as to force the arc to move to a vicinity of the permanent magnet, wherein the stationary contactor has a first stationary contactor and a second stationary contactor, the moving contact is disposed between the first stationary contactor and the second stationary contactor, the first stationary contactor has a first stationary contact and the second stationary contactor has a second stationary contact, a first end of the moving contactor has a first moving contact electrically contacting the first stationary contact and a second end of the moving contactor has a second moving contact electrically contacting the second stationary contact.

11. The electrical contactor system of claim 10, wherein the magnetic blow-out arc quenching device includes a first magnetic blow-out arc quenching device and a second magnetic blow-out arc quenching device, the first magnetic blow-out arc quenching device has a first permanent magnet statically disposed in a vicinity of the first stationary contactor to extinguish a first arc between the first stationary contact and the first moving contact, the second magnetic blow-out arc quenching device has a second permanent magnet statically disposed in a vicinity of the second stationary contactor to extinguish a second arc between the second stationary contact and the second moving contact.

12. The electrical contactor system of claim 11, wherein the first magnetic blow-out arc quenching device includes a first magnetic yoke, the first permanent magnet and the first stationary contactor are disposed in a first accommodation space surrounded by the first magnetic yoke, the second magnetic blow-out arc quenching device includes a second magnetic yoke, the second permanent magnet and the second stationary contactor are disposed in a second accommodation space surrounded by the second magnetic yoke.

13. The electrical contactor system of claim 12, wherein the isolation arc quenching device has a first isolation arc quenching device and a second isolation arc quenching device, the first isolation arc quenching device has a first arc quenching sheet and the second isolation arc quenching device has a second arc quenching sheet.

14. The electrical contactor system of claim 13, wherein the first arc quenching sheet is rotated into a contact region of the first moving contact and the first stationary contact and the first moving contact is electrically isolated from the first stationary contact to cut off the first arc when the moving contactor is rotated to the disconnected position, the second arc quenching sheet is rotated into a contact region of the second moving contact and the second stationary contact and the second moving contact is electrically isolated from the second stationary contact to cut off the second arc when the moving contactor is rotated to the disconnected position.

15. The electrical contactor system of claim 14, wherein the first arc quenching sheet pushes the first arc toward the first permanent magnet to force the first arc to move to a vicinity of the first permanent magnet while the moving contactor is rotated from the connected position toward the disconnected position, the second arc quenching sheet pushes the second arc toward the second permanent magnet to force the second arc to move to a vicinity of the second permanent magnet while the moving contactor is rotated from the connected position toward the disconnected position.

16. The electrical contactor system of claim 15, wherein the first arc quenching sheet is rotated out of a contact region of the first moving contact and the first stationary contact and the first moving contact is in electrical contact with the first stationary contact when the moving contactor is rotated to the connected position, the second arc quenching sheet is rotated out of a contact region of the second moving contact and the second stationary contact and the second moving contact is in electrical contact with the second stationary contact when the moving contactor is rotated to the connected position.

17. The electrical contactor system of claim 16, further comprising a first insulating isolation wall and a second insulating isolation wall, the first arc quenching sheet and the first insulating isolation wall form a gap therebetween or contact with each other to cut-off the first arc when the moving contactor is rotated to the disconnected position, the second arc quenching sheet and the second insulating isolation wall form a gap therebetween or contact with each other to cut-off the second arc when the moving contactor is rotated to the disconnected position.

18. The electrical contactor system of claim 17, wherein the insulating fixing wall has a first insulating fixing wall and a second insulating fixing wall, the first magnetic yoke and the first permanent magnet are clamped and fixed between the first insulating fixing wall and the first insulating isolation wall, the second magnetic yoke and the second permanent magnet are clamped and fixed between the second insulating fixing wall and the second insulating isolation wall.

19. The electrical contactor system of claim 18, wherein a first end of the first magnetic yoke is inserted into a slot of the first insulating fixing wall and a second end of the first magnetic yoke is on a side of the first stationary contactor that is opposite to the first stationary contact, a first end of the second magnetic yoke is inserted into a slot of the second insulating fixing wall and a second end is on a side of the second stationary contactor that is opposite to the second stationary contact.

20. The electrical contactor system of claim 19, wherein the first permanent magnet is embedded in a mounting chamber defined by the first magnetic yoke, the first insulating fixing wall, and the first insulating isolation wall, the second permanent magnet is embedded in a mounting chamber defined by the second magnetic yoke, the second insulating fixing wall, and the second insulating isolation wall.

21. An electrical contactor system, comprising:

a stationary contactor having a stationary contact;

a moving contactor having a moving contact;

a rotating member, the moving contactor is mounted on the rotating member and is rotatable between a connected position and a disconnected position along with the rotating member, the moving contact is in electrical contact with the stationary contact when the moving contactor is rotated to the connected position, the moving contact is separated from the stationary contact when the moving contactor is rotated to the disconnected position;

a magnetic blow-out arc quenching device including a permanent magnet, the permanent magnet is statically disposed in a vicinity of the stationary contactor for elongating an arc between the stationary contact and the moving contact by an electromagnetic force so as to extinguish the arc; an isolation arc quenching device rotated by the rotating member in a direction opposite to a rotational direction of the rotating member and adapted to push the arc toward the permanent magnet so as to force the arc to move to a vicinity of the permanent magnet; and a stationary insulating isolation wall arranged between the permanent magnet and the isolation arc quenching device with the moving contact in the connected position.

* * * * *